US005996163A

United States Patent [19]

Galizia

[11] Patent Number: 5,996,163

[45] Date of Patent: Dec. 7, 1999

[54] FOOT BRUSH ASSEMBLY

[76] Inventor: Michael A. Galizia, 153 Sussex Court, Roselle, Ill. 60172

[21] Appl. No.: 09/036,166

[22] Filed: Mar. 6, 1998

Related U.S. Application Data

[63] Continuation-in-part of application No. 08/705,563, Aug. 29, 1996, Pat. No. 5,724,695.

[51] Int. Cl.[6] ..... A46B 11/00

[52] U.S. Cl. ..... 15/160; 15/104.92; D32/47

[58] Field of Search ..... 15/104.92, 114, 15/160, 161; 4/606; 601/27, 28, 134, 136, 138; D28/63; D32/47

[56] References Cited

U.S. PATENT DOCUMENTS

| | | | |
|---|---|---|---|
| D. 336,198 | 6/1993 | Gibbons . | |
| 3,543,747 | 12/1970 | Gustafson | 15/160 |
| 4,617,917 | 10/1986 | Miller | 15/160 |
| 5,163,200 | 11/1992 | Carlin et al. | 15/114 |
| 5,293,660 | 3/1994 | Park | 15/161 |
| 5,575,034 | 11/1996 | Biernacinski et al. . | |
| 5,709,490 | 1/1998 | Dyas . | |
| 5,724,695 | 3/1998 | Galizia . | |

FOREIGN PATENT DOCUMENTS

| | | | |
|---|---|---|---|
| 2123281 | 2/1984 | United Kingdom | 15/160 |

*Primary Examiner*—Terrence R. Till
*Attorney, Agent, or Firm*—Olson, & Hierl, Ltd.

[57] ABSTRACT

A foot brush assembly for use in the shower or the like including a support base and a base pad removably secured to the top of the support base. The foot is rubbed against the surface of the base pad and a brush thereon for massaging or cleaning the bottom of the foot. In one embodiment, the support base or the base pad includes a securement element which is removably engageable with the other of the support base or the pad for removably securing the base pad to the support base. In another embodiment, the support base and base pad both include securement elements contiguous with the respective surfaces thereof such as removably engageable strips of hook and loop material respectively. A bridge brush is secured over the brush on the base pad to define a foot receiving cavity for massaging or cleaning the top and sides of the foot.

13 Claims, 8 Drawing Sheets

FOOT BRUSH ASSEMBLY

RELATED APPLICATION

This application is a continuation-in-part application of prior application Ser. No. 08/705,563 filed on Aug. 29, 1996, now U.S. Pat. No. 5,724,695, which is hereby incorporated herein by reference.

FIELD OF THE INVENTION

This invention relates to a brush assembly and, more particularly, to an improved brush assembly for massaging and cleaning the feet which includes a cleaning pad and brush combination which is easily removable from the assembly for drying and cleaning after use.

BACKGROUND OF THE INVENTION

A body extremity such as the foot is difficult to massage and clean particularly for individuals who, because of age or other infirmity, are ambulatory or physically disabled and cannot bend or reach over sufficiently to manually massage or cleanse their feet.

While numerous foot brush assemblies have been proposed, they have met with limited success for a number of reasons including, but not limited to, their cost in terms of both purchase and manufacture, their complexity, their bulkiness, and the inability to dry and clean the cleaning pad and associated brush components after use.

It would thus be desirable to provide a foot brush assembly which is economical to manufacture and purchase, simple to use, compact, and which includes a massage and cleaning pad and associated brush components which are easily removable from the assembly for drying and cleaning after use. The present invention meets these needs.

SUMMARY OF THE INVENTION

The foot brush assembly of the present invention comprises a support base and a massage or cleaning base pad disposed over the support base and removably secured thereto. The foot is placed on and brushed against the top of the pad to massage or clean the bottom of the foot.

In one embodiment of the present invention, the support base or the pad includes a securement element thereon which is removably engageable with the other of the support base or the pad for removably securing the pad to the support base.

In another embodiment of the invention, the secured element is contiguous with the surface of either the support base or the pad and is removably and contiguously engageable with one of the surfaces of the other of the support base or pad.

In a further embodiment of the present invention, the support base and the pad both include securement elements contiguous with the respective surfaces thereof such as, for example, strips of loop and hook material respectively which removably and contiguously engage and interlock with each other when the pad is disposed over the support base.

In yet a further embodiment of the present invention, the securement element comprises a strap at each of the corners of the support pad which extends around the corners respectively of the support base.

The various securement elements of the present invention advantageously allow the pad to be removed from the support base after use for drying, cleaning or replacement. A hook on the support pad allows the support pad to be hung to dry. These features eliminate the growth of mildew and other micro-organisms which normally results from the repeated use of a pad which is permanently secured to an assembly.

The base pad includes an integral brush comprising a plurality of bristles extending generally upwardly from the top surface of the pad. The toes and bottom of the foot are massaged or cleaned by brushing the bottom of the foot against the brush.

The base pad further includes an integral bridge pad extending over the brush thereon which defines a cavity adapted to receive the foot of the user. The bridge pad includes a brush comprising a plurality of bristles extending generally outwardly from the bottom surface thereof. The top and sides of the toes and the foot are rubbed against the brush on the bridge pad when the foot is placed inside the foot receiving cavity.

The support base includes a cavity adapted to receive a bar of soap and including holes which allow water to be drained out of the cavity during use.

Both the base pad and the bridge pad are preferably made of a natural sponge-like loofa material or a sisal material which is soft for use on the skin, releases soap at a desired rate and dries rapidly after use thus resisting mildew and the growth of other micro-organisms.

There are other advantages and features of the present invention which will be more readily apparent from the following detailed description of the preferred embodiments of the invention, the accompanying drawings, and the appended claims.

DESCRIPTION OF THE PREFERRED EMBODIMENT

Figure 1:
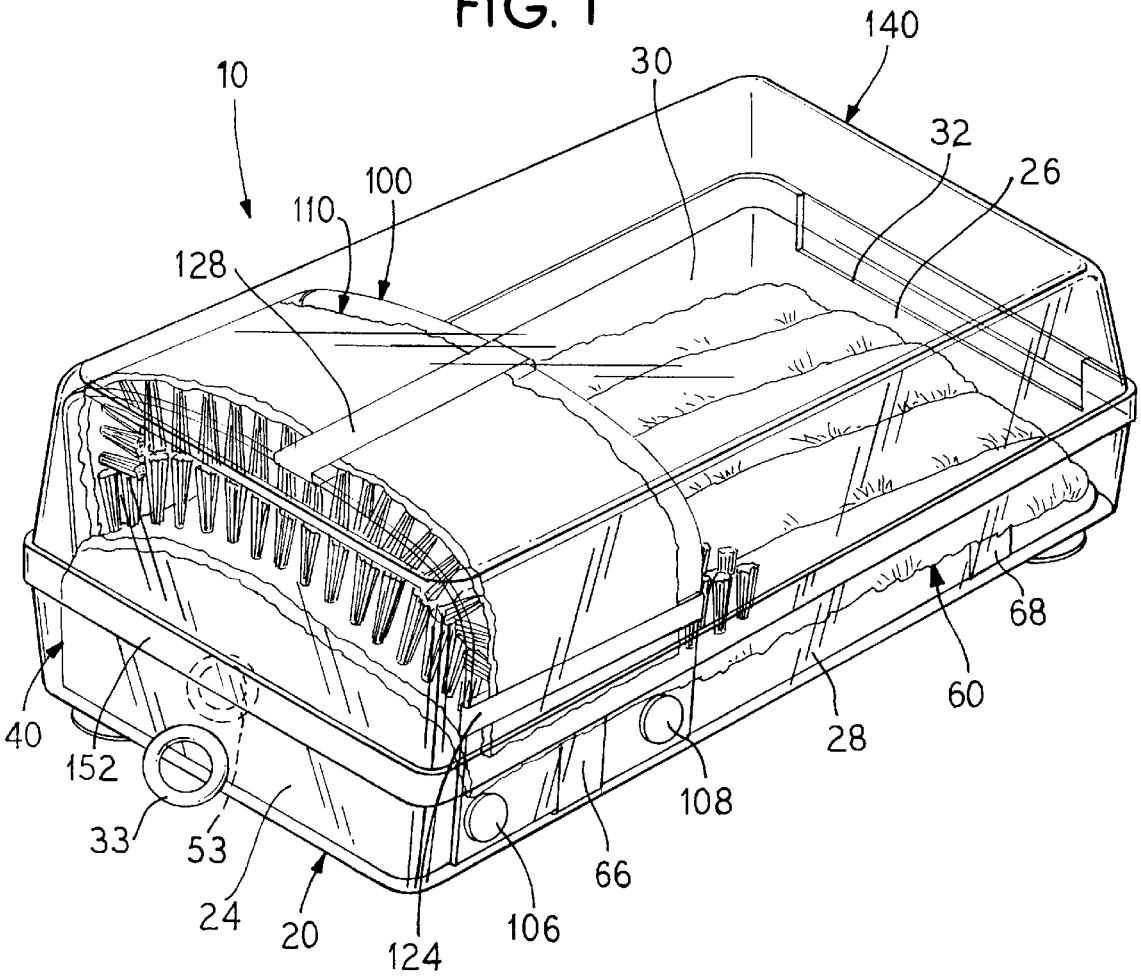
FIG. 1 is a perspective view of a foot brush assembly in accordance with the present invention.

The invention disclosed herein is, of course, susceptible of embodiment in many different forms. Shown in the drawings and described below in detail are preferred embodiments of the invention. It is to be understood, however, that the present disclosure is an exemplification of the principles of the invention and does not limit the invention to the illustrated embodiments.

The precise shapes and sizes of the components described herein are not essential to the invention unless otherwise indicated.

For ease of description, the foot brush assembly of the present invention will be described in its normal horizontal position on the floor of a shower or the like and terms such as top, bottom, horizontal, vertical, etc., will be used with reference to this position. It will be understood, however, that the foot brush assembly of this invention may be manufactured, stored, transported, and sold in an orientation other than the positions described.

A first embodiment of a foot brush assembly 10 in accordance with the present invention is shown in FIGS. 1–7.

Referring to FIGS. 1–4, the foot brush assembly 10 is comprised of a basin or receptacle 20 including a bottom generally horizontal wall 22 (FIG. 4), a front wall 24 and a rear wall 26 extending generally vertically upwardly from and unitary with the front and rear peripheral edges respectively of the bottom wall 22, and opposing sidewalls 28 and 30 extending generally vertically upwardly from and unitary with the peripheral edge of the opposite sides respectively of the bottom wall 22. The rear wall 26 includes an elongate, generally rectangular lip 32 cut out of the top thereof.

A generally circular hook 33 extends unitarily outwardly from the outer surface of the front wall 24 of the basin 20 to allow the basin 20 to be hung and dried after use as will be described later.

Figure 7:
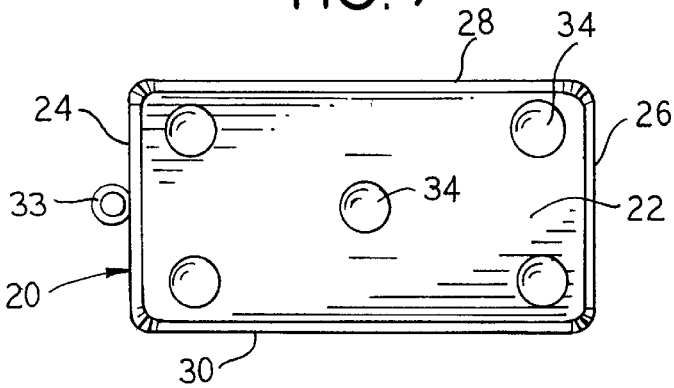
FIG. 7 is a reduced bottom plan view of the basin of the foot brush assembly shown in FIG. 1.

Referring to FIG. 7, a plurality of polymeric suction cups 34, each of somewhat bell shape, are attached by known means to the bottom surface of the bottom wall 22 to allow the releasable anchoring of the basin 20 to the floor of a tub, shower stall or the like. In the embodiment shown, the basin 20 includes four suction cups 34 disposed respectively at the four corners of the bottom of the basin 20 while a fifth suction cup 34 is positioned generally centrally on the bottom of the basin 20. It is understood, of course, that suction cups are simply exemplary of the various types of anchoring means which could be used to anchor the basin 20 to the floor of a shower stall or the like.

Basin 20 can be molded using a thermoplastic polymer and provided in a range of different colors to match various bathroom color schemes. Presently preferred polymers are low density polyethylene (LPD), very low density polyethylene (VLDPE), polypropylene (PP), and the like. All edges and surfaces of the basin 20 are generally rounded or curved to reduce the risk of injury during use.

The dimensions of the basin 20 and the foot brush assembly 10 can vary widely, but generally the foot brush assembly 10 will be designed so that it can be used on substantially all sizes of feet. Typically, the foot brush assembly 10 is approximately 11.5 inches (29.2 cm) long, 6.75 inches (17.1 cm) wide, and 3 inches (7.6 cm) high. The basin 20 is approximately 11.3 inches long (28.7 cm), 6.6 inches wide (16.8 cm), and 2 inches (5 cm) high.

Referring to FIGS. 1–5, the foot brush assembly 10 further comprises a base member 40 including an inclined top wall 42, a generally horizontal bottom wall 44, front and rear generally vertical walls 46 and 48 respectively extending between and unitary with the front and rear peripheral end edges of the top and bottom walls 42 and 44 respectively, and generally vertical sidewalls 50 and 52 extending between and unitary with the peripheral side edges of the top and bottom walls 42 and 44 respectively. A generally circular hook 53 extends unitarily outwardly from the outer surface of the front wall 46 to allow the base member 40 to be hung and dried after use.

Typically, the base member 40 is approximately 11.25 inches (28.5 cm) long and 5.75 inches (14.6 cm) wide. Typically, the front wall 46 has a height of about 1.25 inches (3.2 cm) and the rear wall 48 has a height of about 0.50 inches (1.3 cm) so that the top wall 42 is inclined at an angle of about 10 degrees with respect to the bottom wall 44.

Base member 40 is molded using the same thermoplastic polymer as basin 20. Moreover, all edges and surfaces of the base member 40 are generally rounded or curved to reduce the risk of injury during use.

The base member 40 further includes two spaced apart and co-linearly disposed male snap members 54 and 56 (FIG. 2) secured to each of the side walls 50 and 52 respectively. Snap members 54 and 56 are positioned on the sidewall 50 generally adjacent the front wall 46 of base member 40. Although not shown, snap members 54 and 56 are similarly positioned on sidewall 52.

Figure 3:
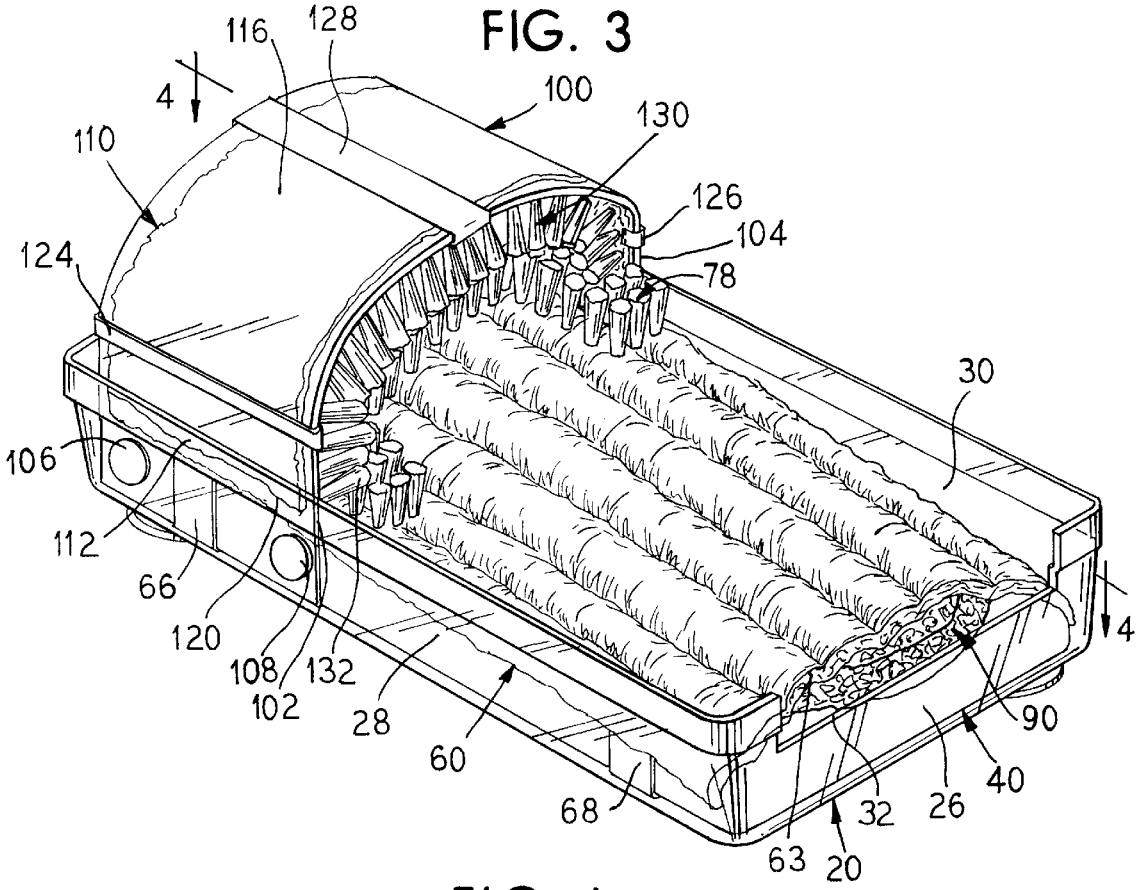
FIG. 3 is a perspective view of the foot brush assembly of FIG. 1 with the cover removed therefrom.
Figure 4:
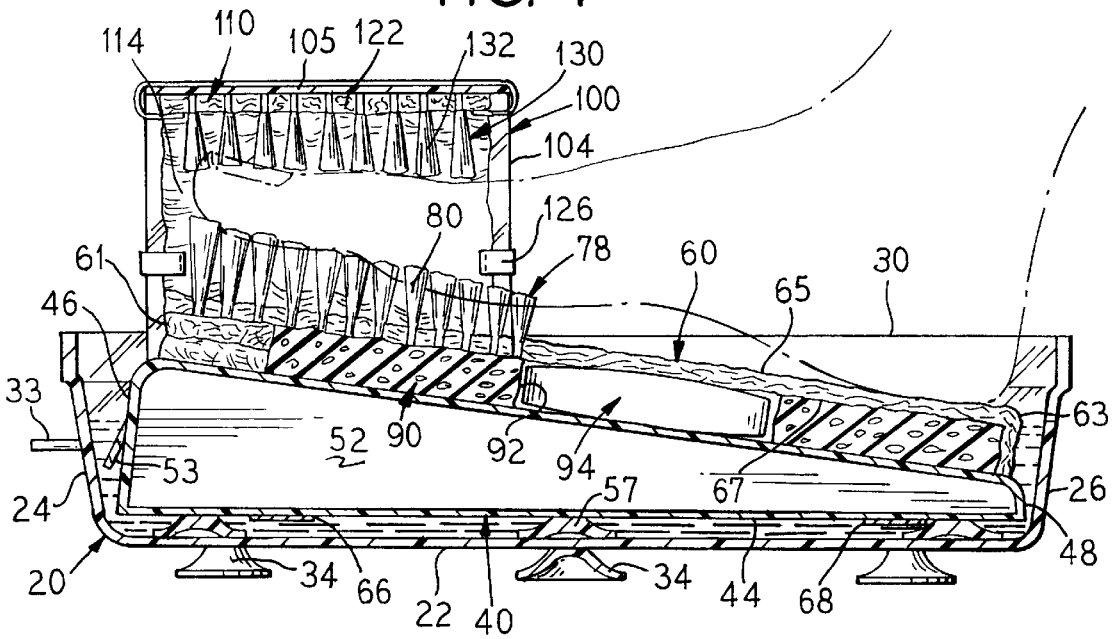
FIG. 4 is a vertical cross-sectional view of the foot brush assembly taken generally along the plane 4—4 in FIG. 3 with a user's foot shown therein in phantom.
Figure 6:
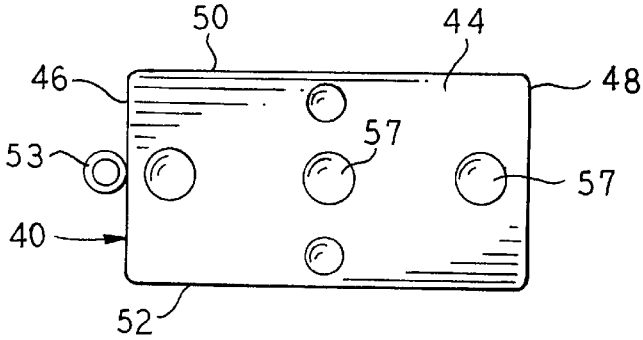
FIG. 6 is a reduced bottom plan view of the base member of FIG. 5.

Referring to FIG. 6, base member 40 includes a plurality of suction cups 57, each also of somewhat bell shape, attached by know means to the bottom surface 44 to allow the releasable anchoring of base member 40 inside the basin 20 as shown in FIGS. 3 and 4.

In the embodiment of FIG. 6, the base member 40 includes five suction cups 57 secured to the bottom of bottom wall 44 thereof. Three of the suction cups 57 have a diameter greater than the other two suction cups 57. The three suction cups 57 with a greater diameter extend co-linearly along the longitudinal axis of the base member 40 in spaced-apart relationship with one of the suction cups being disposed generally centrally on the bottom of the base member 40. The other two suction cups 57 are disposed on opposite sides of the centrally disposed suction cup 57 and adjacent the front and rear walls 46 and 48 respectively of the base member 40.

The two suction cups having a smaller diameter extend co-linearly along the transverse axis of the base member 40 and generally adjacent the sidewalls 50 and 52 on opposite sides of the centrally disposed suction cup 57 respectively. It is understood, of course, that suction cups are simply exemplary of the various known means which could be used to anchor the base member 40 inside the basin 20.

Figure 2:
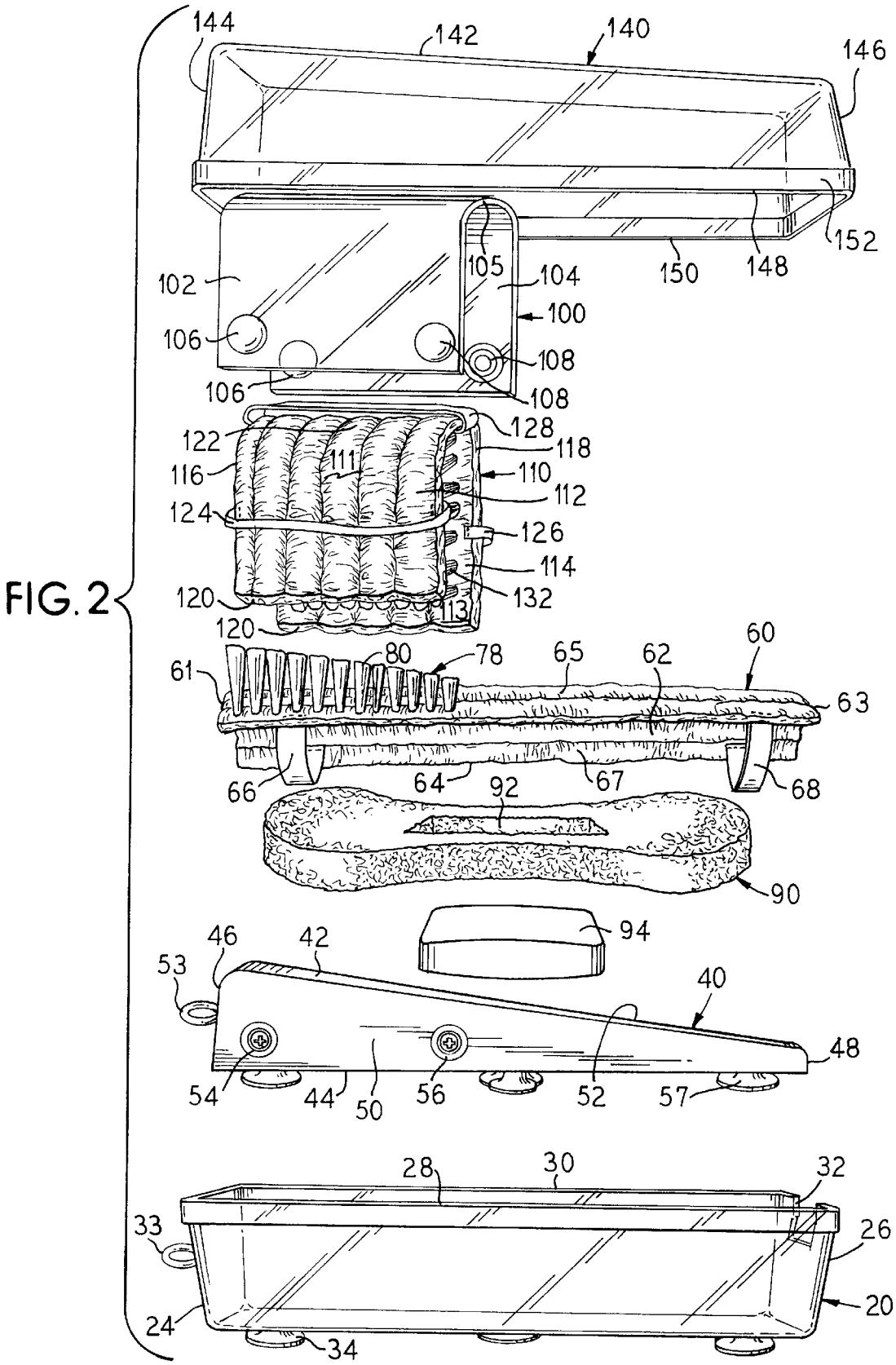
FIG. 2 is an exploded perspective view of the foot brush assembly of FIG. 1.
Figure 5:
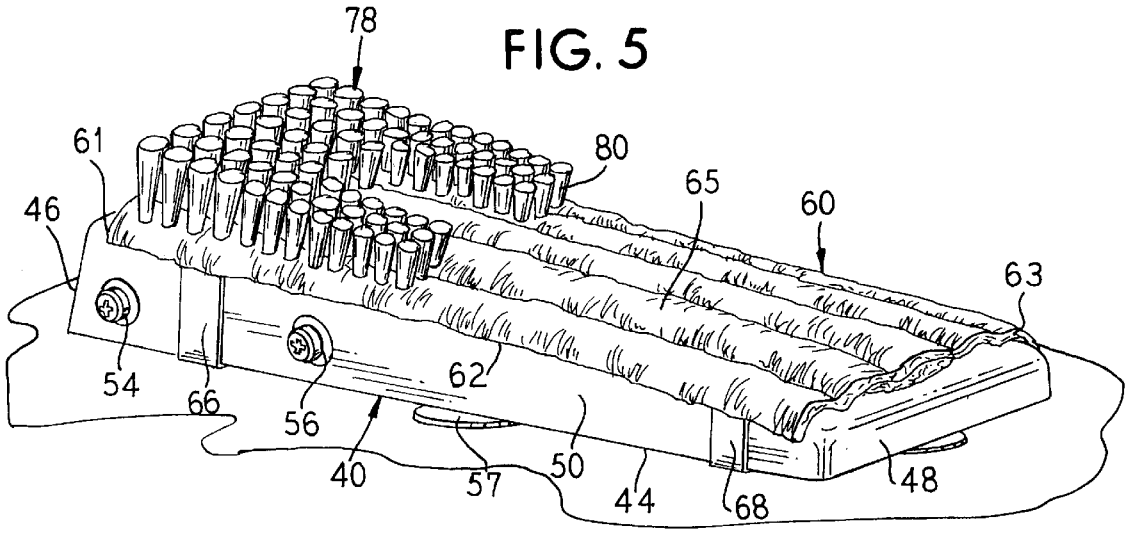
FIG. 5 is a perspective view of the base member of the foot brush assembly with a loofa base pad removably secured thereto.

Referring to FIGS. 2, 4 and 5, the foot brush assembly 10 further comprises a massaging and cleaning pad 60. The pad 60 is made of a sponge-like loofa plant fiber material which is used for massaging and cleaning and is made from a loofa plant which has been dried, has had the skin and seeds removed therefrom, and has had its fibers washed and dried. The result of this process is a massaging and cleaning pad 60 which is soft for use on the skin, releases soap at a desired rate and dries rapidly after use thus resisting mildew and the growth of other micro-organisms.

Although the use of a pad 60 made of a loofa material is preferred, it is understood that the material could be substituted with any other suitable massaging or cleaning material such as a cloth material.

As shown in FIG. 2, pad 60 is generally rectangularly shaped and is defined by a front peripheral edge 61, a rear peripheral edge 63, and opposite peripheral side edges 62 and 64. Pad 60 includes an upper surface 65 and a lower surface 67. Pad 60 has a length and width about equal to the length and width of the base member 40.

Pad 60 includes first and second elongate and generally wide straps 66 and 68 integral therewith which are preferably each made of a wide band of elastic material. Strap 66 extends along the width and lower surface 67 of the pad 60 adjacent to and parallel the front edge 61 of pad 60. Strap 68 extends along the width and lower surface 67 of the pad 60 adjacent to and parallel the rear edge 63 of pad 60.

One end of strap 66 is secured by stitching, gluing or other suitable method to the lower surface 67 of pad 60 adjacent the side edge 62 thereof while the opposite end of strap 66 is secured to the lower surface 67 of pad 60 adjacent the side edge 64 of pad 60.

Similarly, one end of strap 68 is secured by stitching, gluing or other suitable method to the lower surface 67 of pad 60 adjacent the side edge 62 of pad 60 while the opposite end of strap 68 is secured to the lower surface 67 of pad 60 adjacent the side edge 64 of pad 60.

Pad 60 further includes a generally U-shaped brush 78 (FIG. 5) for applying a massaging and scrubbing action to the toes and arch of a foot upon movement of the foot thereagainst as will be described later. Brush 78 comprises a plurality of filament tufts 80 which extend integrally upwardly from the upper surface 65 of the pad 60. Tufts 80 can be secured to the pad 60 by any suitable means including adhesive.

The diameter of the fibers used to form the filament tufts 80 of the brush 78 can vary widely but will generally be within from about 0.008 to about 0.025 inches (between about 0.020 cm and 0.063 cm) while the selection of the particular fiber will generally depend upon the degree of firmness desired to be imparted to the filament tufts 80. Polymers such as polyamide, polypropylene, polyethylene, co-polymers of polypropylene and ethylene, co-polymers of polypropylene and ethylene, polyflouride and the like can be used in the formation of the filament tufts 80.

In the embodiment shown in FIG. 5, the brush 78 includes a plurality of spaced-apart and parallel rows of tufts 80. The first row of tufts 80 extends along the width of the pad 60 adjacent to and parallel the front peripheral edge 61 of pad 60. The remaining rows extend rearwardly from the first row of tufts 80 in the direction of the rear peripheral edge 63 of pad 60 in spaced-apart and parallel relationship.

The height of each of the rows of filament tufts 80 decreases uniformly and gradually starting with the first row of tufts 80 and moving rearwardly towards the last row of tufts 80. Preferably, the tufts 80 decrease in height from a height of about 1.50 inches (3.8 cm) at the first row of filament tufts 80 to a height of about 1 inch (2.5 cm) at the last row of filament tufts 80. By providing a brush 78 of decreasing height, a massaging and scrubbing force is created in the area where the toes are joined to the foot.

The foot brush assembly 10 further comprises a sponge 90 (FIGS. 2 and 4) including a centrally disposed generally rectangularly shaped cavity 92 adapted and configured to receive a bar of soap 94. The term soap is used in a generic sense to include any type of solid detergent or cleaning material that is dissolved during use.

Referring to FIGS. 3 and 4, the sponge 90 is adapted to be placed between the base member 40 and the base pad 60. More particularly, sponge 90 is placed against the top surface 42 of the base member 40 and the bar of soap 94 is adapted to be placed into the cavity 92 of sponge 90 and against the top surface 42 of the base member 40.

The loofa base pad 60 is adapted to be removably secured to the base member 40 by stretching and wrapping the straps 66 and 68 of the pad 60 around, and into abutting relationship with, the sidewalls 50 and 52 and the bottom surface 44 of base member 40 such that the lower surface 67 of the pad 60 abuts the outer surface of the sponge 90 and the top surface 42 of the base member 40.

Referring to FIGS. 2–4, foot brush assembly 10 further comprises a generally U-shaped and arcuate bridge member 100 including two generally vertical, spaced-apart, parallel sidewalls 102 and 104 respectively and a generally arcuate top wall 105 extending between and unitary with the top peripheral edges of the sidewalls 102 and 104 respectively. Each of the sidewalls 102 and 104 includes first and second spaced-apart, co-linearly disposed, female snap members 106 and 108 respectively secured thereto adjacent the bottom peripheral edge of the sidewalls 102 and 104 respectively.

The bridge member 100 is molded using the same thermoplastic polymer as basin 20 and base member 40. Moreover, all edges and surfaces of the bridge member 100 are generally rounded or curved to reduce the risk of injury during use.

The foot brush assembly 10 further comprises a bridge member pad 110 which is also preferably made of the same type of loofa material as the base pad 60. Bridge member pad 110 is a generally rectangularly shaped pad which is folded into a U-shaped member as shown in FIG. 2. In its folded position, the bridge member pad 110 includes an outer surface 111 and an inner surface 113, opposite peripheral side edges 116 and 118, first and second generally vertically oriented, spaced-apart and parallel sidewalls 112 and 114, each including a bottom peripheral edge 120, and a top generally arcuate top wall 122 therebetween and unitary with the top peripheral transverse edges of the sidewalls 112 and 114 respectively.

Bridge member pad 110 additionally includes first and second elongate and generally wide straps 124 and 126 integral with the sidewalls 112 and 114 respectively and a third strap 128 integral with the top arcuate wall 122. Each of the straps 124, 126 and 128 is preferably made of an elongate and generally wide band of elastic material.

Strap 124 extends along the width of, and is centrally disposed over, the outer surface 111 of sidewall 112. One end of the strap 124 is secured by stitching, gluing or other suitable method to the inner surface 113 of the pad 110 adjacent the peripheral side edge 116 of sidewall 112 while the opposite end of strap 124 is secured to the inner surface 113 of pad 110 adjacent the peripheral side edge 118 of sidewall 114.

In a similar manner, strap 126 extends along the width of, and is centrally disposed over, the outer surface 111 of sidewall 114. One end of the strap 126 is secured to the inner surface 113 of the pad 110 adjacent the peripheral side edge 116 of pad 110 while the opposite end thereof is secured to the inner surface 113 of the pad 110 adjacent the peripheral side edge 118 of the pad 110. Straps 124 and 126 are co-planarly disposed with respect to each other.

Strap 128 extends along the width of, and is centrally disposed over, the outer surface 111 of the top wall 122. One end of strap 128 is secured to the inner surface 113 of pad 110 adjacent the peripheral side edge 116 of pad 110 while the other end thereof is secured to the inner surface 113 of pad 110 adjacent the peripheral side edge 118 thereof.

Referring to FIGS. 3 and 4, bridge pad 110 includes a brush 130 extending integrally outwardly from the inner surface 113 of pad 110 for applying a massaging and scrubbing action to the top and side surfaces of a foot upon movement of the foot thereagainst as will be described later. The brush 130, like the brush 78 of base pad 60, is comprised of a plurality of spaced-apart and parallel rows of filament tufts 132. The first row of filament tufts 132 is disposed adjacent to and extends along and parallel to the bottom peripheral edge 120 of the sidewall 112. The second and subsequent rows of filament tufts 132 are spaced from and parallel to the first row of filament tufts 132 and extend around the inner surface 113 of the U-shaped pad 110. The last row of filament tufts 132 extends adjacent to and along and parallel to the bottom peripheral edge 120 of the sidewall 114 (FIG. 2).

Each of the tufts 132 is secured into the pad 110 such that it extends perpendicularly outwardly from the inner surface 113 thereof. Preferably, each of the tufts 132 has a length of about 1 inch (2.5 cm) and the individual fibers thereof are made of the same polymeric material as the fibers of the filament tufts 80 of the brush 78 on base pad 60.

The loofa bridge pad 110 is adapted to be removably strappably secured to the bridge member 100. Initially, and although not shown, strap 128 is stretched and looped around the sidewall 112. The pad 110 is then inserted into the interior cavity of the bridge member 100 and the sidewalls 112 and 114 and the top wall 122 of the pad 110 are positioned into abutting relation with the sidewalls 102 and 104 and the top wall 105 respectively of bridge member 100 and the strap 128 is positioned centrally over and in abutting relation with the outer surface 111 of the top wall 122 of bridge member 110 as shown in FIG. 3. Straps 124 and 126 are then stretched and wrapped around the sidewalls 112 and 114 respectively and thereafter positioned centrally on, and in abutting relation with, the outer surface 111 of sidewalls 112 and 114 respectively, as shown in FIGS. 1 and 3 so as to secure the pad 110 to the bridge member 100.

Bridge pad member 100 is adapted to be releasably secured to the base member 40 as shown in FIGS. 3 and 4. Referring to FIGS. 2 and 3, sidewall 102 of bridge member 100 is secured to the sidewall 50 of the base member 40 by snapping the female snap members 106 and 108 in sidewall 102 of bridge member 100 into the mating male snap members 54 and 56 respectively in the sidewall 50 of the base member 40. In a like fashion, and although not shown, the sidewall 104 of bridge member 100 is releasably secured to the sidewall 52 of the base member 40 by snapping the female snap members 106 and 108 respectively in the sidewall 104 of bridge member 100 into the mating male snap members 54 and 56 respectively in the sidewall 52 of the base member 40.

Although the embodiment shown discloses the use of mating snap members to releasably secure the bridge member 100 to the base member 40, it is understood that the invention encompasses any other suitable known means for effecting such releasable securement such as a hoop and loop type securement means.

In its releasably secured position, the bridge member 100 is positioned such that the peripheral end edges of the tufts 132 of brush 130 on the bridge pad 110 oppose the peripheral end edges of the tufts 80 of the brush 78 on base pad 60. More particularly, the brushes 78 and 130 are so situated with respect to each other such that the toes of a foot naturally extend into a cavity formed between the peripheral end edges of the respective brushes 78 and 130 without an unnatural deflection of the toes as best seen in FIG. 4.

Referring to FIGS. 1 and 2, the foot brush assembly 10 further comprises a cover 140 including a top surface 142, a front wall 144 and a rear wall 146 extending unitarily generally downwardly from the peripheral front and rear edges respectively of the top surface 142, and sidewalls 148 and 150 extending generally downwardly from and unitary with the peripheral side edges of the top surface 142. The cover 140 additionally includes a shoulder 152 extending circumferentially along and adjacent the lower edge of the walls of the cover 140. As shown in FIG. 1, the cover 140 is adapted to fit over the basin 20 with the shoulder 152 seated against the top edge of the walls of the basin 20. The cover 140 may be placed over the foot brush assembly 10 when it is not in use. Alternatively, the cover 40 may be used as a foot rinse basin as described later.

The cover 140 is also molded using the same thermoplastic polymer as the basin 20, the base member 40 and the bridge member 100. Moreover, all edges and surfaces of the cover 140 are generally rounded or curved to reduce the risk of injury during use.

The foot brush assembly 10 of the present invention is advantageously utilized in a shower and is placed on the floor of the shower basin. According to the invention, the foot brush assembly 10 can be used in the shower in either the FIG. 3 embodiment or the FIG. 5 embodiment.

In the FIG. 3 embodiment, the foot brush assembly 10 includes the basin 20 with the base member 40 seated in the interior of basin 20 and the bridge member 100 removably secured to the base member 40. The basin 20 is secured to the shower floor via suction cups 34 on the bottom surface thereof. When used as shown in FIG. 3, the basin 20 may be filled with water to a level where a portion of the base member 40, sponge 90, soap 94 and base pad 60 are covered with water. The foot to be massaged or cleaned is positioned on top of the base pad 60 substantially as shown in FIG. 4 with the toes and instep of the foot fitted within the cavity between the brushes 78 and 130 of the base pad 60 and the bridge pad 110 respectively. In this position, the tufts 80 of brush 78 abut the bottom of the toes, the ball of the foot, and the arch of the foot and the tufts 132 of brush 130 abut the top and sides of the toes and the top and sides of the instep of the foot. The heel of the foot is seated on and abuts the rear of the base pad 60.

The foot is then moved in a fore and aft direction to effect a thorough massaging and cleaning action. More particularly, the fore and aft movement of the foot against the top surface 65 of the base pad 60 causes the massaging and cleaning of the heel and arch portions of the foot. Moreover, the fore and aft movement of the foot causes the base pad 60 to contact the bar of soap 94 to create a soap lather which travels through the base pad 60 and onto the foot. The wide fiber structure of the loofa material allows the free movement of the soap lather through the base pad 60. Further, the fore and aft movement of the foot within the cavity defined by brushes 78 and 130 of the base pad 60 and the bridge pad 110 respectively causes the brush 78 on base pad 60 to cleanse the bottom of the toes, and the ball of the foot. Still further, the fore and aft movement of the foot causes the brush 130 on bridge pad 110 to cleanse the top and sides of the toes, and the top and sides of the foot instep. The fore and aft movement of the foot within the basin 20 is accommodated by the lip 32 in the rear wall 26 of the basin 20.

The suction cups 57 on the bottom of the base member 40 prevent the base member 40 from slipping in the basin 20 during the fore and aft movement of the foot on top of the base member 40. When use has been completed, the basin 20 may be hung by its hook 33 to allow the same to drip dry.

The basin 20 allows the FIG. 3 foot brush assembly embodiment to be used outside the shower either as a foot cleaning assembly or a foot massaging assembly with or without water in the basin 20 and with or without the soap 94. Where the assembly 10 is used as a foot cleaning assembly outside the shower, the cover 140 can be filled with water and used as a foot rinse basin.

Alternatively, the foot brush assembly 10 can be used in a shower or the like in the embodiment as shown in FIG. 5 where the base member 40 is secured to the floor of the shower basin and is used in a similar fashion as the FIG. 3 embodiment but without either the basin 20 or the bridge member 100. When used as depicted in FIG. 5, the lather would be produced by the water flowing down from the shower head into contact with the base pad 60 during use. When use has been completed, the base member 40 may be hung by its hook 53 to allow the same to drip dry.

To speed the drying process after use and to minimize the growth of mildew or other micro-organisms, the bridge pad 110 can advantageously be removed from the bridge member 100 and the base pad 60 and sponge 90 can advantageously be removed from the base member 40. The use of a loofa material speeds the drying process. The removability feature also allows the base pad 60 and bridge pad 100 to be washed or replaced.

A second embodiment of a foot brush assembly 210 in accordance with the present invention is shown in FIGS. 8–11.

The foot brush assembly 210 is comprised of a support or stability base 240 including a body 241 having an inclined top surface 242, a generally horizontal bottom surface 244 (FIG. 10), front and rear generally vertical surfaces 246 and 248 respectively extending between and unitary with the front and rear peripheral end edges of the top and bottom surfaces 242 and 244 respectively, and generally vertical side surfaces 250 and 252 extending between and unitary with the peripheral side edges of the top and bottom surfaces 242 and 244 respectively.

Typically, the base member 240 is approximately 12 inches (30 cm) long and 9.5 inches (24 cm) wide. Typically, the front surface 246 has a height of about 0.25 inches (0.63 cm) and the rear surface 248 has a height of about 0.125 inches (0.31 cm) so that the top surface 242 is inclined at an angle of about 10 degrees with respect to the bottom surface 244.

Support base 240 can be molded from any suitable soft material such as rubber or other thermoplastic polymer and provided in a range of different colors to match various bathroom color schemes. All edges and surfaces of the base 240 are generally rounded or curved to reduce the risk of injury during use.

Figure 9:
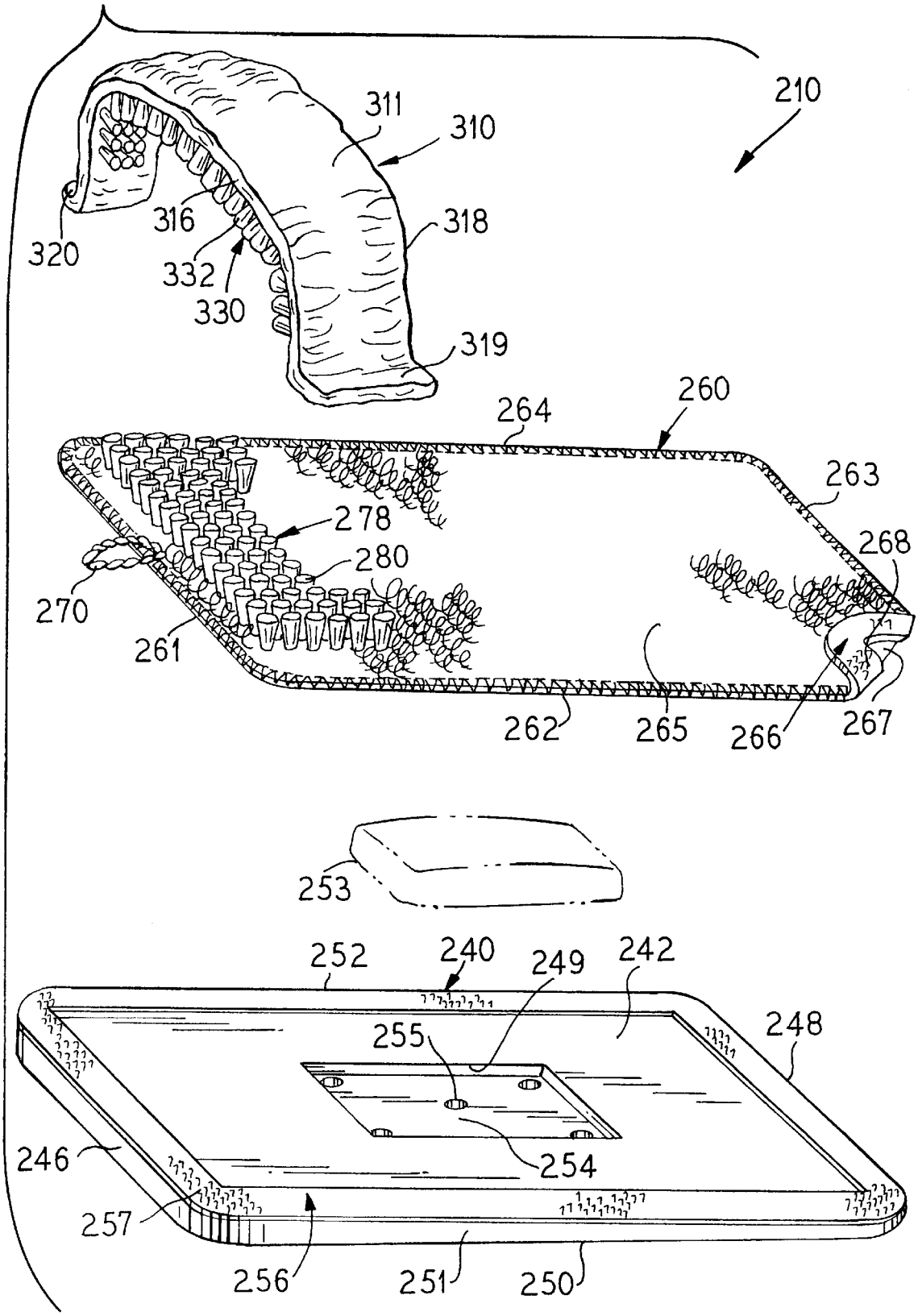
FIG. 9 is an exploded perspective view of the foot brush assembly of FIG. 8.
Figure 10:
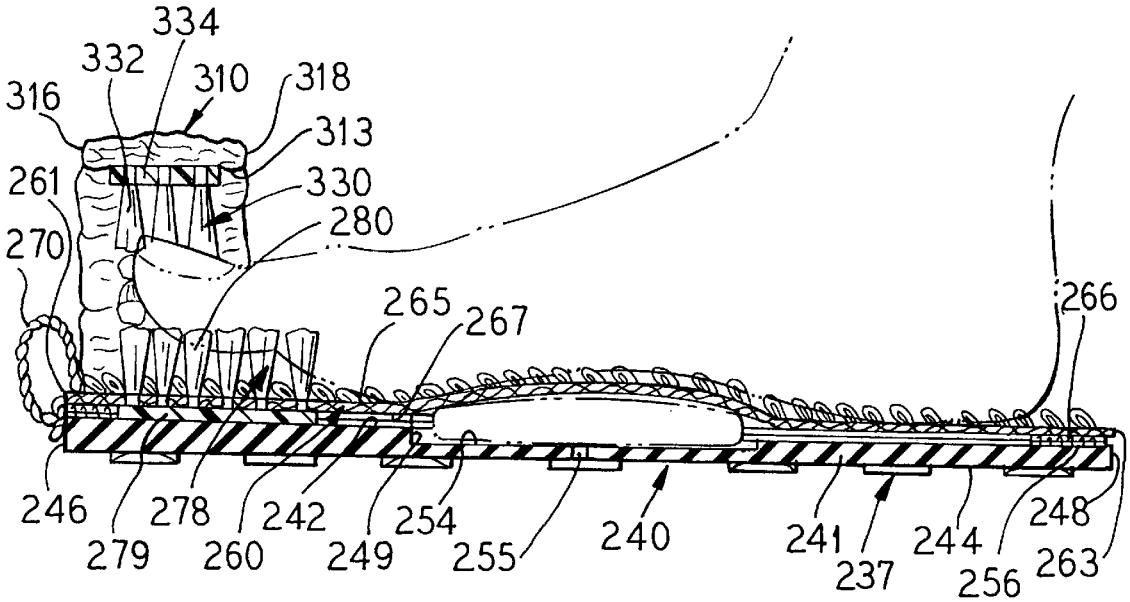
FIG. 10 is a vertical cross-sectional view of the foot brush assembly taken generally along the plane 10—10 in FIG. 8 with a user's foot shown therein in phantom.

Referring to FIGS. 9 and 10, a cavity 249 is formed in the body 241 of the base 240 and is adapted to receive a bar of soap 253. Cavity 249 extends inwardly from the top surface 242 of the base 240 and includes a flat bottom surface 254 which is spaced from and parallel to the bottom surface 244 of the base 240. A plurality of water drain holes 255 extend between the bottom surface 254 of the cavity 249 and the bottom surface 244 of the base 240. Although the cavity 249 can be of any desired shape and orientation, in the embodiment shown, the cavity 249 is rectangularly shaped and oriented on the base 240 such that its longitudinal axis is co-linearly disposed with the longitudinal axis of the base 240.

Figure 11:
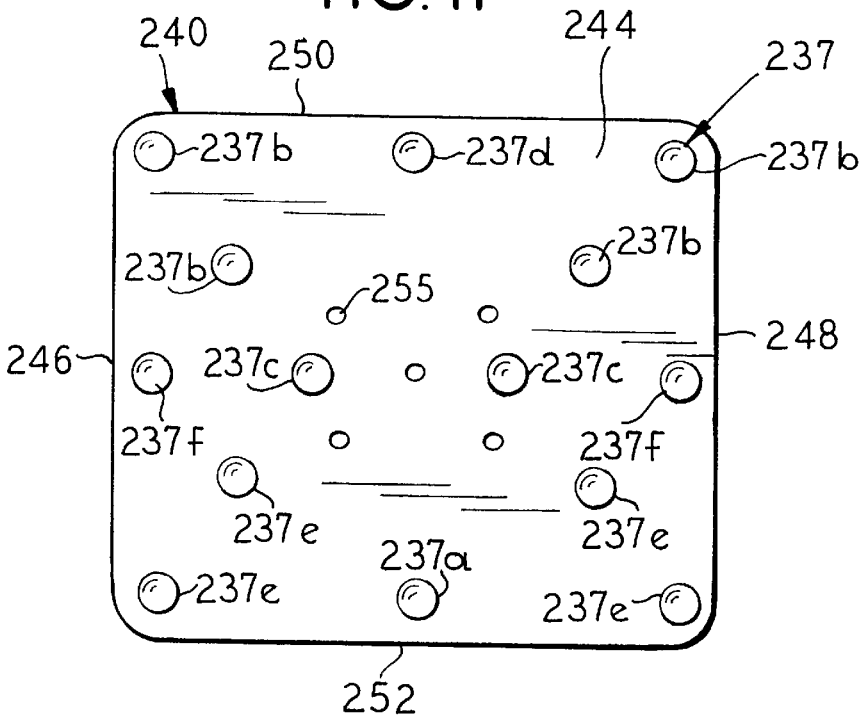
FIG. 11 is a reduced bottom plan view of the base of the foot brush assembly of FIG. 8.

A plurality of polymeric suction cups 237 (FIGS. 10 and 11) are molded into, and unitary with, the bottom surface 244 of the support base 240 to allow the releasable anchoring of the base 240 to the floor of a tub, shower stall or the like. In the embodiment of FIG. 11, suction cups 237*a*, 237*b* and 237*c* are positioned and aligned on the base 240 in spaced-apart relationship in a "V" configuration. The suction cup 237*a* is positioned centrally adjacent the edge of the side surface 252 of the base 240 and defines the point of the "V". The suction cups 237*b* and 237*c* extend in a spaced-apart and co-linear relationship towards the opposite top corners of the base 240 (as viewed in FIG. 11) to define the two sides of the "V".

Suction cups 237*c*, 237*d* and 237*e* are positioned and aligned on the pad 240 in spaced-apart relationship in an inverted "V" configuration. The suction cup 237*d* is positioned centrally on the base 240 adjacent the edge of the side surface 250 thereof and defines the point of the inverted "V". The suction cups 237*c* and 237*e* extend in spaced-apart and co-linear relationship towards the opposite bottom corners of the base 240 (as viewed in FIG. 11) to define the two sides of the inverted "V". The two "V" configurations overlap each other such that the suction cups 237*a* and 237*d* defining the points of the respective "V" configurations are co-linearly aligned with each other and the suction cups 237*c* are common to both the "V" and inverted "V" configurations.

Suction cups 237*c* and 237*f* extend co-linearly along the longitudinal axis of the base 240. Suction cups 237*f* are disposed adjacent the front and rear surfaces 246 and 248 of the base 240 respectively.

It is understood, of course, that the suction cups 237 are simply exemplary of the various types of releasable anchoring means which could be used to anchor the base 240 to the floor of a shower stall or the like and further that the "V" configurations are simply exemplary of the various configurations which could be used.

The base 240 further includes a securement element 256 (FIG. 9) comprising an elongate strip of a Velcro® type hook material 257 extending around the entire periphery of, and contiguous with, the top surface 242 of the base 240. The strip of hook material 257 is contiguously secured to the top surface 242 of the base 240 by any known securement process such as, for example, stitching or gluing. Alternatively, it is understood that the base 240 could be manufactured with the securement element 256 unitary therewith.

The foot brush assembly 210 further comprises a massaging and cleaning pad 260. Pad 260 is a cloth-like pad made from the washed and dried natural fibers of the leaves of a sisal plant. Like the loofa pad 60 of brush assembly 10, the pad 260 is soft on the skin, releases soap at a desired rate and dries rapidly after use.

Although the use of a pad 260 made of a sisal plant material is disclosed, it is understood that the pad 260 can be made of any other suitable massaging or cleaning material or natural fibers such as, for example, a cotton material.

Figure 8:
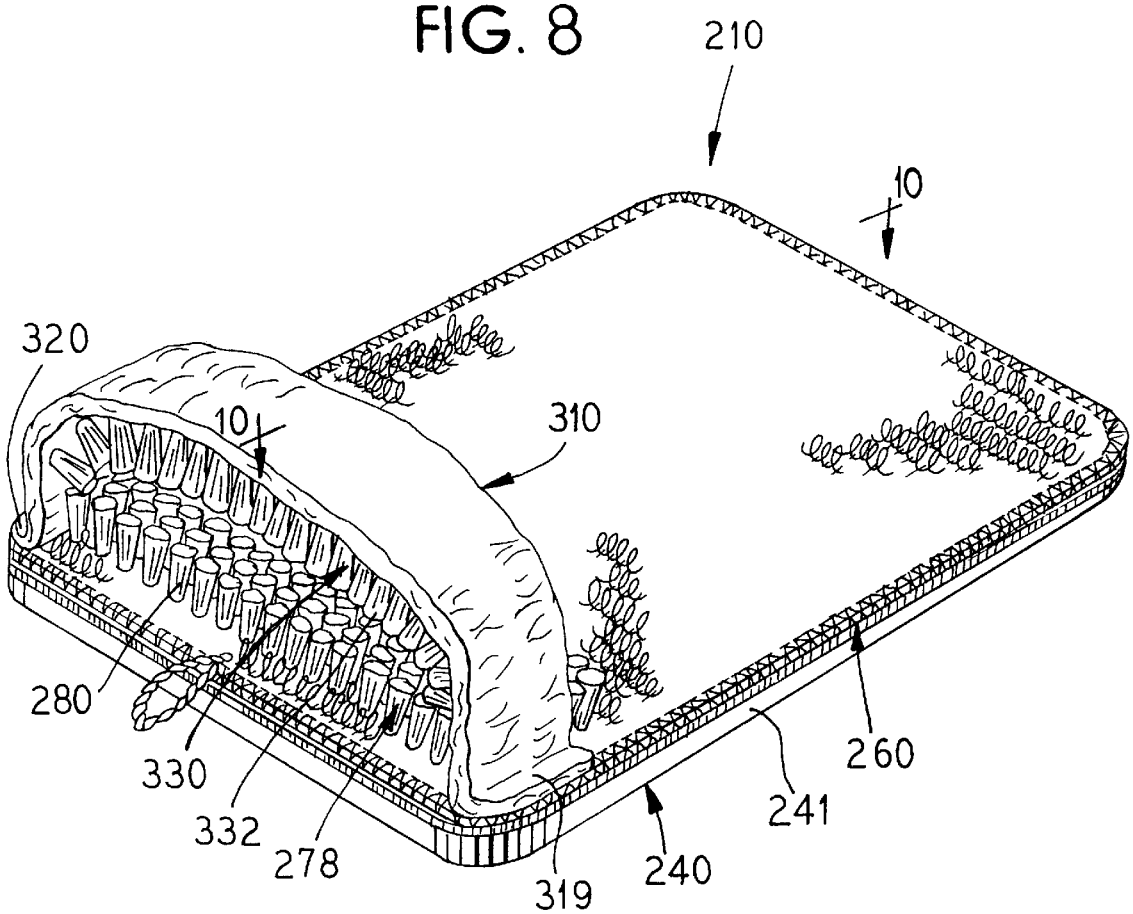
FIG. 8 is a perspective view of another embodiment of a foot brush assembly in accordance with the present invention.

The pad 260 depicted in FIGS. 8 and 9 is generally rectangularly shaped and is defined by a front peripheral edge 261, a rear peripheral edge 263, and opposite peripheral side edges 262 and 264. Pad 260 includes a top surface 265 and a bottom surface 267. Pad 260 has a length and width about equal to the length and width of the base 240.

Pad 260 includes a securement element 266 (FIG. 9) comprising an elongate strip of a Velcro® type loop material 268 contiguous with the bottom surface 267 of the pad 260. Although not shown, it is understood that the strip 268 extends around the periphery of, and contiguous with, the bottom surface 267 in a manner similar to the strip 256 on the base 240. The strip 268 is secured to the bottom surface 267 of the pad 260 by any known securement process such as, for example, stitching, or gluing. The strip 268 could also be unitary with the pad 260.

A hook 270 extends unitarily outwardly from the front peripheral edge 261 of the pad 260 to allow the pad 260 to be hung and dried after use.

Pad 260 also includes a generally U-shaped brush 278 (FIG. 9) adapted to apply a massaging and scrubbing action to the toes and arch of a user's foot upon movement of the user's foot thereagainst as will be described later. Brush 278 comprises a plurality of filament or bristle tufts 280 which extend upwardly from the top surface 265 of the pad 260 in spaced-apart relationship. The tufts 280 are secured into the pad 260 with the use of a plastic or the like material backing plate 279 (FIG. 10) which is secured to the bottom surface 267 of the pad 260. The tufts 280 are embedded and secured into the plate 279. Although not shown, it is understood that the tufts 280 can secured to the pad 260 by any other suitable means such as, for example, gluing or stitching directly into the body of the pad 260.

The size and composition of the fibers used to form the filament tufts 280 of the brush 278 is the same as the size and composition of the filament tufts 80 of the brushes used in foot brush assembly 10.

As shown in FIGS. 9 and 10, brush 278 includes a plurality of spaced-apart and parallel rows of tufts 280. The first row of tufts 280 extends along the width of the pad 260 adjacent to and parallel the front peripheral edge 261 thereof. The next three rows also extend along the width of the pad 260 and rearwardly in spaced-apart and parallel relationship to the first row of tufts 280. The last two rows of tufts 280 extend rearwardly in spaced-apart and parallel relationship to and from the fourth row of tufts 280. The last two rows, however, include only three tufts 280 on each side of the pad 260 so as to define the U-shaped brush.

It is understood, of course, that the particular brush embodiment of FIG. 9 is only exemplary of the many brush embodiments and configurations contemplated by the invention. Although not shown in FIG. 9, it is also understood that the height of each of the rows of filament tufts 280 can be uniformly and gradually decreased from the front peripheral edge 261 of the pad 260 rearwardly in the same manner and for the same purpose as described earlier with respect to the brush 78 on foot brush assembly 10.

The pad 260 is adapted to be removably secured to, and held in place on, the top surface 242 of the base 240. In the embodiment shown, the strips of hook and loop material 257 and 268 respectively on the base 240 and the pad 260 respectively define securement elements or strips which removably and contiguously engage and interlock with each other when the pad 260 is disposed on the base 240.

It is understood, of course, that the invention encompasses any other suitable type of removably engageable support elements for removably securing the pad 260 to the base 240 such as, for example, the straps of assembly 10.

The invention further encompasses any suitable securement element contiguous with the surface of either the base 240 or the pad 260 which is removably and contiguously engageable with the surface of the other of the base 240 or the pad 260 such as, for example, a strip of adhesive or hook type material on the top surface of the base 240 which is removably and contiguously engageable with the bottom surface of the pad 260. Another example of suitable removably engageable support elements are cooperating snap members contiguous with the surfaces of the base 240 and the pad 260. It is further understood that the removably engageable contiguous securement elements can be secured to any of the surfaces of the base 240 or the pad 260 such as, for example, the bottom surface of the base 240.

Foot brush assembly 210 further comprises a bridge pad 310 which is preferably made of the same type of loofa material as the base pad 60 of foot brush assembly 10. Bridge pad 310 is generally elongate and, arcuately shaped, and includes a top surface 311, a bottom surface 313 (FIG. 10), and opposite peripheral side surfaces 316 and 318. The longitudinal ends of the bridge pad 310 are bent outwardly and define flat securement flaps 319 and 320.

Bridge pad 310 includes a brush 330 extending integrally outwardly from the bottom surface 313 thereof and adapted to apply a massaging and scrubbing action to the top and side surfaces of a user's foot upon movement of the user's foot thereagainst as will be described later.

Brush 330 includes three spaced-apart and parallel rows of filament or bristle tufts 332 extending substantially the entire length of the bridge pad 310. Tufts 332 are anchored in a backing or support plate 334 (FIG. 10) which is secured, by gluing, stitching or the like to the bottom surface 313 of the bridge pad 310. Plate 334 is preferably composed of a plastic material and the tufts 332 are preferably anchored into the surface of the plate 334 in a pre-assembly manufacturing step. It is understood, of course, that the tufts 332 can be secured to the pad 310 by any other suitable means such as, for example, gluing or stitching directly into the bridge pad 310. It is further understood that the plate 334 provides a rigidity to the bridge pad 310 which allows the top of the bridge pad 310 to be used as a secondary pad as described below for cleaning the bottom of the foot.

Bridge pad 310 is permanently secured to and integral with the pad 260. Bridge pad 310 extends the width of the pad 260 and is positioned directly above and in spaced relationship to the brush 278 on the pad 260 such that the first three rows of tufts 280 of the brush 278 on the pad 260 are co-planarly aligned with the three rows of tufts 332 of the brush 330 on the bridge pad 310. The flaps 319 and 320 of the bridge pad 310 are seated on the pad 260 adjacent the front edge 261 and respective peripheral side edges 262 and 264 of the pad 260 and the respective outer edges of the brush 278. Flaps 319 and 320 are permanently secured to the pad 260 by any suitable means such as, for example, gluing or stitching.

The space between the brushes 278 and 330 defines a cavity adapted to receive the toes and instep of a user's foot as shown in FIG. 10 and as will be described later.

Although the bridge pad 310 is permanently secured to the pad 260 in the embodiment of FIG. 8, it is understood that the invention encompasses a bridge pad 310 which is removably securable to the pad 260 using any suitable known elements or structure for effecting releasable securement of the flaps 319 and 320 of the pad 310 to the pad 260 such as, for example, a hook and loop type, adhesive, or snap type securement elements.

The foot brush assembly 210 of the present invention is advantageously utilized in a shower or bath and is placed on the floor of the shower or tub much in the same way as the foot brush assembly 10.

The suction cups 237 on the bottom of the base 240 hold the assembly 210 in place during use. The foot to be massaged or cleaned is positioned on top of the pad 260 substantially as shown in FIG. 10 with the toes and instep of the foot fitted within the cavity between the brushes 278 and 330 on the base pad 260 and the bridge pad 310 respectively. In this position, the tufts 280 of brush 278 abut the bottom of the toes, the ball of the foot, and the arch of the foot while the tufts 332 of the brush 330 abut the top and sides of the toes and the top and sides of the instep of the foot. The heel of the foot is seated on and abuts the rear of the pad 260.

The foot is then moved in a fore and aft direction to effect a thorough massaging and cleaning action. More particularly, the fore and aft movement of the foot against the top surface 265 of the pad 260 causes the massaging and cleaning of the heel and arch portions of the foot. Moreover, and as shown in FIG. 10, the fore and aft movement of the foot causes the base pad 260 to contact the bar of soap to create a soap lather which travels through the pad 260 and onto the foot. The drain holes 255 in the base 240 advantageously allow water to drain out of the soap receiving cavity 249 during use.

The fore and aft movement of the foot within the cavity defined by the brushes 278 and 330 respectively causes the brush 278 on pad 260 to cleanse the bottom of the toes, and the ball of the foot and brush 330 to cleanse the top and sides of the toes, and the top and sides of the foot instep. For additional cleaning action, the user's foot can be placed against, and moved in a fore and aft direction on, the top surface 311 of the bridge pad 310. The plate 334 secured to the bottom surface 313 of the bridge pad 310 advantageously prevents the buckling of the bridge pad 310 when the foot is placed thereagainst.

To speed the drying process after use and to minimize the growth of mildew or other micro-organisms, the pad 260 can advantageously be removed from the base 240 and hung by hook 270 to allow the same to drip dry. The removability feature also allows the pad 260 to be washed or replaced after use.

Figure 12:
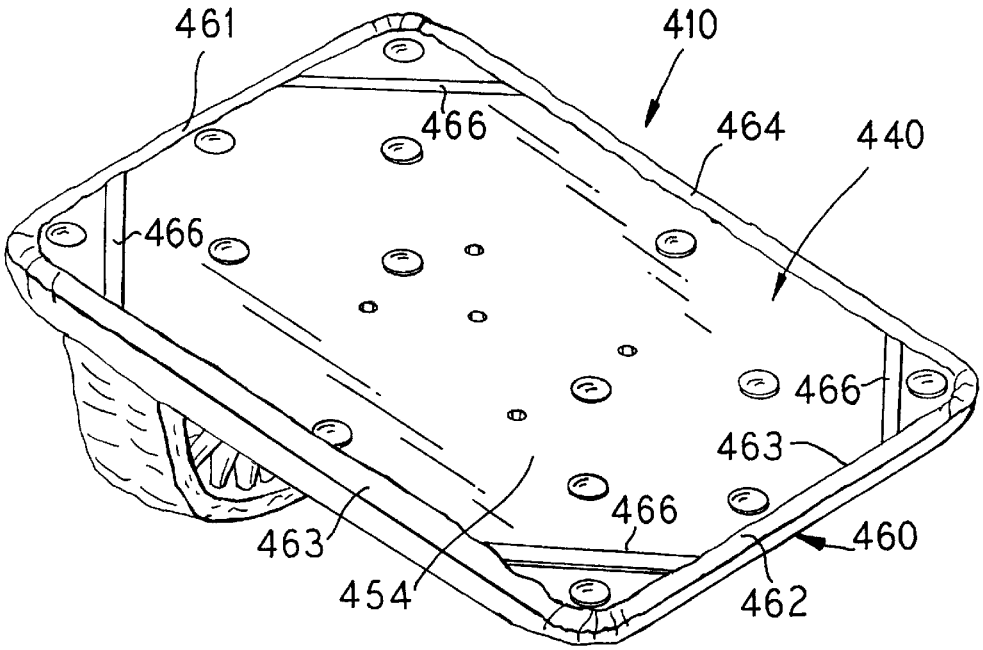
FIG. 12 is a perspective view of yet another embodiment of a foot brush assembly in accordance with the present invention.

FIG. 12 depicts the bottom of another embodiment of a foot brush assembly 410 including a support base 440 and pad 460. The base 440 is identical in structure to the base 240 of the foot brush assembly 210. The pad 460 is similar in structure to the pad 260 of the foot brush assembly 210 except that the pad 460 includes front, rear, and side peripheral edges 461, 462 463 and 464 respectively which are removably wrappable around the edges and corners of the base 440 and incorporates alternate elements for removably securing the pad 460 to the base 440.

More particularly, pad 460 includes straps 466 secured respectively to the corners thereof. Each of the straps 466 is preferably made of a band of elastic material. The straps 466 at the top of the pad 460 (as viewed in FIG. 12) are spaced from the respective top corners of the pad 460 and the ends thereof extend between the top front peripheral edge 461 and respective side peripheral edges 463 and 464 of the pad 460. The straps 466 at the rear or bottom of the pad 460 are similarly spaced from the respective rear or peripheral bottom corners of the pad 460 and the ends thereof extend between the rear or bottom peripheral edge 462 and respective side edges 463 and 464 of the pad 460. The ends of the straps 466 are secured to the respective peripheral edges of the pad 460 by stitching, gluing, or other suitable securement method.

The pad 460 is removably secured to the base 440 by placing the pad 460 against the base 440 and wrapping the corners and associated straps 466 of the pad 460 around the corners of the base 440.

It is understood that the straps 466 could be substituted with a pad 460 including elasticized or fitted corners which are wrapped around the corners of the base 240 substantially as shown in FIG. 12. It is further understood that the brush assembly 410 could also include any other suitable type of removably engageable support element or surface such as, for example, a strip(s) of loop material on the corners of the pad 460 which are removably engageable with a corresponding strip(s) of hook material on the corners of the bottom surface 454 of the base 440. Alternatively, the corners could include cooperating snap structures or the like.

Figure 13:
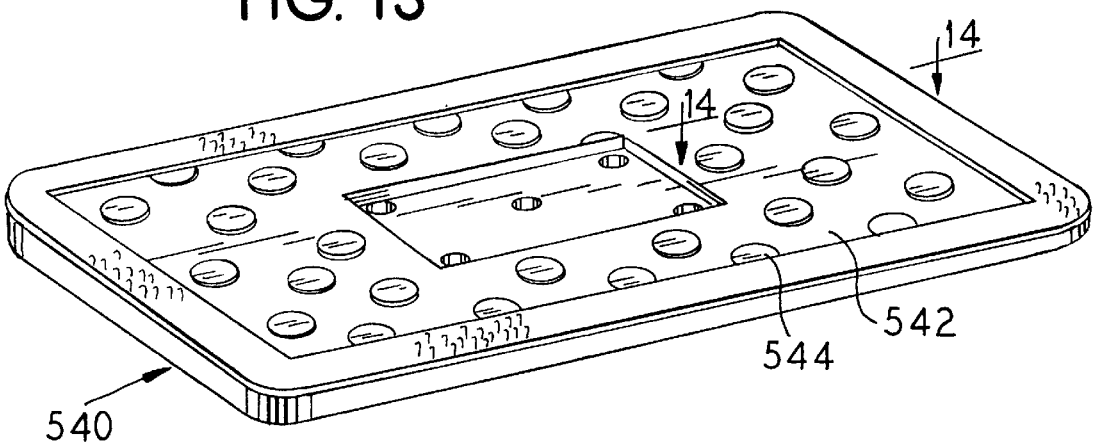
FIG. 13 is a perspective view of an alternate embodiment of the base of the foot brush assembly of FIG. 8.
Figure 14:
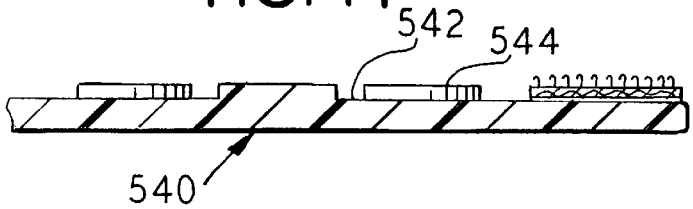
FIG. 14 is a fragmentary vertical cross-sectional view of the base taken generally along the plane 14—14 in FIG. 13.

FIGS. 13 and 14 depict yet another alternate base embodiment 540 similar in structure to the base 240 of foot brush assembly 210 except that the top surface 542 thereof includes a plurality of spaced-apart and staggered projections 544 which extend upwardly from the surface 542 to provide a non-slip base surface. The projections 544 also define cylindrically shaped outwardly extending fingers or buttons which are adapted to exert a massaging action to the bottom of the foot during use.

It is further understood that the various base embodiments shown and described herein and, particularly the base embodiment 540, are adapted to be used without the associated cleaning pad as a non-slip bath or shower stability mat. In this application, the projections 544 in the base 540 afford the additional advantage or providing a soothing massaging action to the bottom of the foot while taking a shower.

The foot brush assembly of the present invention thus provides a compact, self-contained foot brush assembly which can readily and easily be used to thoroughly cleanse and/or massage the feet without needing to bend over or lift the foot. The component structure of the various embodiments and, more particularly, the removably engageable securement elements on the surface(s) of the support pad and/or cleaning pad, such as the hook and loop type strips of material, allow the cleaning pad to be easily removed from the assembly after use for drying or cleaning. The use of pads made of natural fibers such as loofa or sisal plant material improves the cleaning effectiveness and helps to speed the drying process thus eliminating the growth of mildew or other micro-organisms.

What is claimed is:

1. A foot brush assembly comprising:

a support base including a top surface;

a first securement element on said top surface of said support base comprising a strip of hook or loop material extending around and contiguous with the periphery of the top surface of said support base;

a cleaning or massage pad including a bottom surface and disposed over said support base and adapted to receive a user's foot which is brushed against said pad to massage or clean the bottom of the foot; and a second securement element on said pad comprising a strip of hook or loop material extending around and contiguous with the periphery of the bottom surface of said pad which interlocks with the hook or loop material respectively on said first securement element for removably securing said pad to said support base.

2. A foot brush assembly comprising:

a support base;

a cleaning or massage pad, said pad being disposed over said support base and adapted to receive a user's foot which is brushed against said pad to massage or clean the bottom of the foot; and a securement element on said support base or said pad which is removably engageable with the surface of the other of said support base or said pad for removably securing said pad to said support base.

3. The foot brush assembly of claim 2 wherein said securement element is contiguous with one of the surfaces of said support base or said pad.

4. The foot brush assembly of claim 2 wherein said support base includes top, bottom and side surfaces and said securement element comprises a strip of hook material contiguous with one of the top, bottom or side surfaces of said support base which is removably and contiguously engageable with a lower surface of said pad.

5. A foot brush assembly comprising:

a support base;

a cleaning or massage pad including a lower surface, said pad being disposed over said support base and adapted to receive a user's foot which is brushed against said pad to massage or clean the bottom of the foot; and a securement element for removably securing said pad to said support base comprising a strip of adhesive contiguous with the lower surface of said pad and removably and contiguously engageable with one of the surfaces of said support base.

6. A foot brush assembly comprising:

a support base including a top surface;

a base pad including top and bottom surfaces, said base pad being disposed over said support base and adapted to receive a user's foot which is brushed against said base pad so that the bottom of the foot can be massaged or cleaned;

a base brush integral with said base pad and including a plurality of bristles extending generally upwardly from said top surface thereof, the toes and bottom of the foot being massaged or cleaned by brushing the bottom of the foot against said brush;

a bridge pad integral with said base pad and extending over said base brush on said base pad, said bridge pad including top and bottom surfaces and defining a foot receiving cavity between said bridge pad and said base pad;

a bridge brush on said bridge pad including a plurality of bristles extending generally outwardly from the bottom surface thereof, the top and sides of the toes and the foot being rubbed against said bridge brush when the foot is placed inside said foot receiving cavity defined by said bridge pad; and removably engageable hook and loop material on the bottom surface of said base pad and said top surface of said support base respectively for removably securing said base pad to said support base.

7. The foot brush assembly of claim 6 wherein said support base includes a strip of hook material extending around and contiguous with the periphery of said top surface thereof and said base pad includes a strip of loop material extending around and contiguous with the periphery of said bottom surface thereof.

8. The foot brush assembly of claim 6 further including a hook integral with and extending outwardly from the periphery of said base pad for hanging said pad after use.

9. The foot brush assembly of claim 6 further comprising a cavity in said support base adapted to receive a bar of soap, said cavity including water drain holes.

10. A foot brush assembly comprising:

a support base including corners;

a cleaning or massage pad including corners and being disposed over said support base and adapted to receive a user's foot which is brushed against said pad to massage or clean the bottom of the foot; and a securement element associated with the corners of said support base or said pad for removably securing said pad to said support base, said securement element comprising a strap at each of the corners of said pad which extends around the corners respectively of said support base.

11. The foot brush assembly of claim 10 wherein said securement element comprises a strap at each of the corners of said pad which extends around the corners respectively of said support base.

12. A foot brush assembly comprising:

a support base including corners;

a cleaning or massage pad including corners and being disposed over said support base and adapted to receive a user's foot which is brushed against said pad to massage or clean the bottom of the foot; and a securement element associated with the corners of said support base or said pad for removably securing said pad to said support base, said securement element comprising a strip of elastic material unitary with said pad respectively and said corners of said pad are wrappable around said corners of said support base.

13. A foot brush assembly comprising:

a support base including corners;

a cleaning or massage pad including corners and being disposed over said support base and adapted to receive a user's foot which is brushed against said pad to massage or clean the bottom of the foot; and a securement element associated with the corners of said support base or said pad for removably securing said pad to said support base, said securement element comprising a strip of hook material at each of the corners of said support base, the corners of said pad being wrapped around said corners of said support base and said strip of hook material removably engaging the corners of said pad.

* * * * *